US011631337B2

(12) United States Patent
Itabashi et al.

(10) Patent No.: US 11,631,337 B2
(45) Date of Patent: Apr. 18, 2023

(54) OPTIMAL-ROUTE GENERATING SYSTEM

(71) Applicant: SUBARU CORPORATION, Tokyo (JP)

(72) Inventors: Naoaki Itabashi, Tokyo (JP); Mitsuru Kono, Tokyo (JP); Tomoki Kabayama, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 202 days.

(21) Appl. No.: 16/700,752

(22) Filed: Dec. 2, 2019

(65) Prior Publication Data

US 2020/0211404 A1 Jul. 2, 2020

(30) Foreign Application Priority Data

Dec. 27, 2018 (JP) ..... JP2018-244024

(51) Int. Cl.
*G08G 5/04* (2006.01)
*G08G 5/00* (2006.01)

(52) U.S. Cl.
CPC ..... *G08G 5/045* (2013.01); *G08G 5/0021* (2013.01); *G08G 5/0034* (2013.01); *G08G 5/0039* (2013.01)

(58) Field of Classification Search
CPC .... G08G 5/045; G08G 5/0021; G08G 5/0034; G08G 5/0039; G08G 5/0008; G08G 5/0052
See application file for complete search history.

(56) References Cited

U.S. PATENT DOCUMENTS

2002/0080059 A1 6/2002 Tran
2003/0122701 A1 7/2003 Tran
(Continued)

FOREIGN PATENT DOCUMENTS

JP 11-139396 A 5/1999
JP 2001-124849 A 5/2001
(Continued)

OTHER PUBLICATIONS

Yongguo, Zhu et al., "Trajectory Planning Algorithm Based on Quaternion for 6-DOF Aircraft Wing Automatic Position and Pose Adjustment Method," 2010, Chinese Journal of Aeronautics, 23, p. 711 (Year: 2010).*
(Continued)

*Primary Examiner* — Aniss Chad
*Assistant Examiner* — Madison R Hughes
(74) *Attorney, Agent, or Firm* — McDermott Will & Emery LLP

(57) ABSTRACT

An optimal-route generating system for generating an optimal route for achieving a predetermined state relative to a target includes a route candidate generator and an optimal route generator. The route candidate generator is configured to generate a plurality of route candidates for allowing a first craft to reach a predetermined state relative to the target after a predetermined elapsed time period from a current state of the first craft by changing the acceleration of the first craft among a current position, speed, and acceleration of the first craft. The optimal route generator is configured to generate the optimal route by selecting a route candidate with an optimal evaluation result based on an evaluation function from among route candidates, included in the plurality of generated route candidates, not deviating from a predetermined limitation and unlikely to collide with another object including either one of a ground and the target.

6 Claims, 4 Drawing Sheets

(56) References Cited

U.S. PATENT DOCUMENTS

| | | | | |
|---|---|---|---|---|
| 2005/0165516 | A1* | 7/2005 | Haissig | G08G 5/0008 244/175 |
| 2008/0249669 | A1* | 10/2008 | Skarman | G08G 5/0078 701/3 |
| 2012/0191333 | A1* | 7/2012 | Sawhill | G08G 5/0052 701/122 |
| 2018/0016027 | A1* | 1/2018 | Cheatham, III | B64C 39/024 |
| 2018/0276999 | A1* | 9/2018 | Dacre-Wright | G05D 1/042 |
| 2019/0011921 | A1* | 1/2019 | Wang | G06V 20/10 |
| 2019/0039613 | A1* | 2/2019 | Lee | G08G 1/167 |
| 2020/0039638 | A1* | 2/2020 | Hunkel | B64C 19/00 |
| 2020/0166956 | A1* | 5/2020 | Stoschek | G06K 9/6267 |
| 2020/0175881 | A1* | 6/2020 | Trim | G08G 5/0043 |

FOREIGN PATENT DOCUMENTS

| | | | |
|---|---|---|---|
| JP | 2002-308130 | A | 10/2002 |
| JP | 2003-522990 | A | 7/2003 |
| JP | 2018-084972 | A | 5/2018 |

OTHER PUBLICATIONS

Japanese Notice of Reasons for Refusal issued in corresponding Japanese Patent Application No. 2018-244024, dated Jul. 26, 2022, with English translation.

* cited by examiner

OPTIMAL-ROUTE GENERATING SYSTEM

CROSS-REFERENCE TO RELATED APPLICATIONS

The present application claims priority from Japanese Patent Application No. 2018-244024 filed on Dec. 27, 2018, the entire contents of which are hereby incorporated by reference.

BACKGROUND

The disclosure relates to optimal-route generating systems, and particularly, to an optimal-route generating system for generating an optimal route used for achieving a predetermined state relative to a target.

For instance, when a formation flight is to be performed by aircrafts, if a first aircraft (e.g., an accompanying aircraft) in an automatic pilot mode is to fly while following a second aircraft (e.g., a leader aircraft), it is desirable that the flight route of the second aircraft be ascertained.

In this case, information about the flight route is acquired from the second aircraft if the flight route information can be acquired from the second aircraft. If the flight route information is not acquirable from the second aircraft, the flight route of the second aircraft is predicted (e.g., see Japanese Unexamined Patent Application Publication (JP-A) No. 2001-124849).

Although JP-A No. 2001-124849 describes a method of using the Kalman filter theory as a method for predicting the flight route of the second aircraft, the prediction method is not limited to this. For instance, a flight-dynamics-based method or a probability-based method may be used.

In a method for causing the first aircraft to fly while following the second aircraft whose flight route has been recognized in this manner, the first aircraft is often controlled based on the relative position, the relative speed, and the relative acceleration between the first aircraft and the second aircraft (e.g., see Japanese Unexamined Patent Application Publication (Translation of PCT Application) 2003-522990 and JP-A 11-139396).

SUMMARY

An aspect of the disclosure provides an optimal-route generating system configured to generate an optimal route for achieving a predetermined state relative to a target. The optimal-route generating system includes a route candidate generator and an optimal route generator. The route candidate generator is configured to generate a plurality of route candidates for allowing a first craft to reach a predetermined state relative to the target after a predetermined elapsed time period from a current state of the first craft by changing the acceleration of the first craft among a current position, speed, and acceleration of the first craft. The optimal route generator is configured to generate the optimal route by selecting a route candidate with an optimal evaluation result based on an evaluation function from among route candidates, included in the plurality of generated route candidates, not deviating from a predetermined limitation and unlikely to collide with another object including either one of a ground and the target.

An aspect of the disclosure provides an optimal-route generating system configured to generate an optimal route used for achieving a predetermined state relative to a target. The optimal-route generating system includes circuitry. The circuitry is configured to generate a plurality of route candidates for allowing a first craft to reach a predetermined state relative to the target after a predetermined elapsed time period from a current state of the first craft by changing the acceleration of the first craft among a current position, speed, and acceleration of the first craft. The circuitry is configured to generate the optimal route by selecting a route candidate with an optimal evaluation result based on an evaluation function from among route candidates, included in the plurality of generated route candidates, not deviating from a predetermined limitation and unlikely to collide with another object including either one of a ground and the target.

BRIEF DESCRIPTION OF THE DRAWINGS

The accompanying drawings are included to provide a further understanding of the disclosure and are incorporated in and constitute a part of this specification. The drawings illustrate example embodiments and, together with the specification, serve to explain the principles of the disclosure.

DETAILED DESCRIPTION

Figure 1:
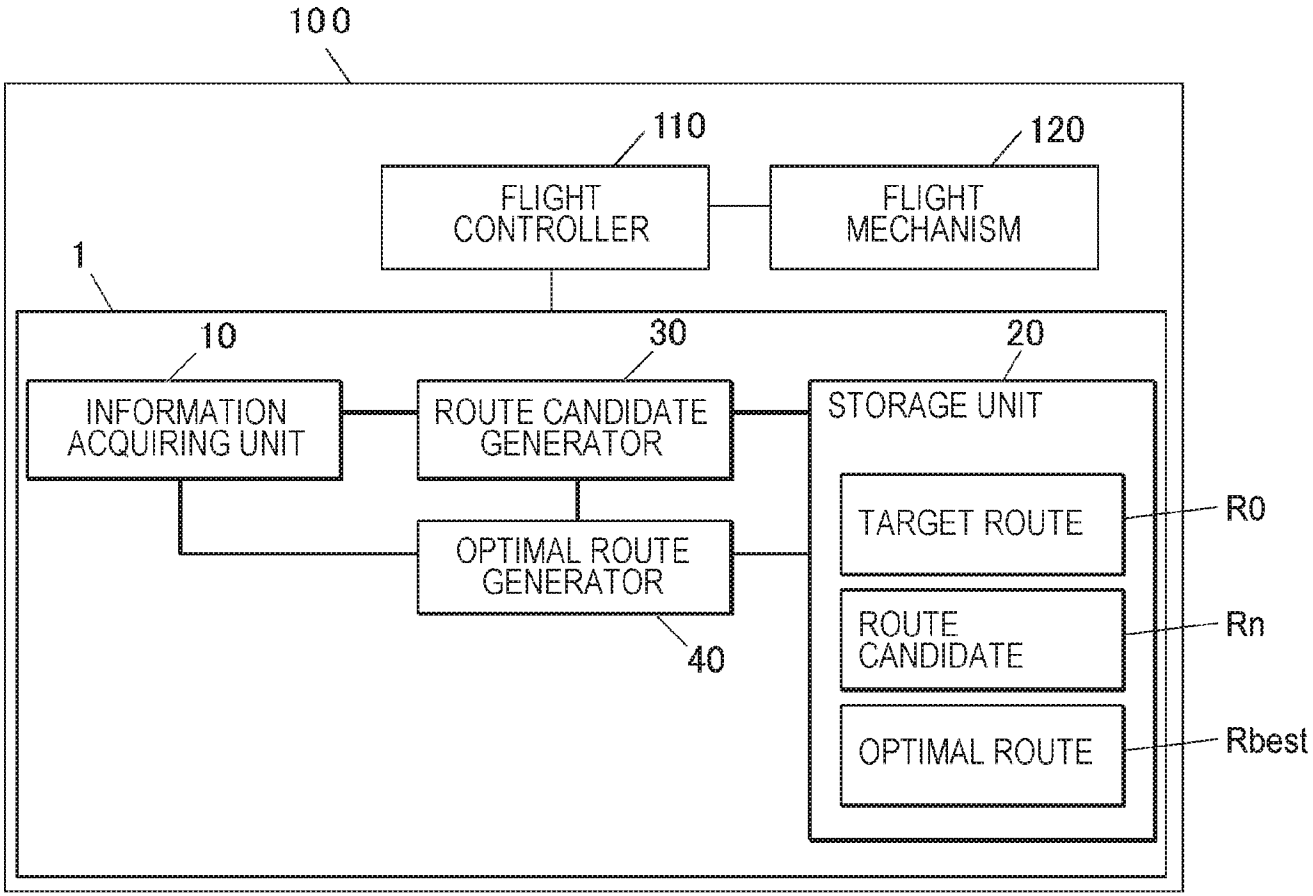
FIG. 1 is a block diagram illustrating the configuration of an aircraft including an optimal-route generating system according to an embodiment.

When a first aircraft is already in a flight mode for following a second aircraft, such as during a formation flight or air refueling, control is performed based on the relative position between the first aircraft and the second aircraft, so that the position and speed of the first aircraft can be maintained at a predetermined position and speed of the second aircraft.

However, for example, if the first aircraft is flying at a position distant from the second aircraft and is to be controlled such that the first aircraft switches from the current flight mode to a flight mode for following the second aircraft, simple control based on the relative position between the first aircraft and the second aircraft may possibly cause the first aircraft to collide with the second aircraft or the ground.

For example, when the first aircraft flying on the right side of the second aircraft is to be moved to the left side of the second aircraft, if the target position is set to the left side of the second aircraft simply based on the relative position, the first aircraft making a left turn may collide with the second aircraft from the right side, possibly resulting in an accident.

Therefore, in order to control the first aircraft to switch to the flight mode for following the second aircraft, a route that prevents collisions with the second aircraft and the ground is to be set as a route used by the first aircraft for switching from the current flight mode to the flight mode for following the second aircraft.

This similarly applies to when, for example, a route for a vehicle or a marine vessel is to be set. Specifically, a route is to be set to prevent collisions with other vehicles or marine vessels. Furthermore, in addition to moving targets, such as other aircrafts, vehicles, and marine vessels, this also similarly applies to when, for example, a route used for reaching a target fixed in the air or to a predetermined location on the ground is to be set.

It is desirable to provide an optimal-route generating system that can generate an optimal route used for allowing a first craft to reach a predetermined state relative to a target without causing the first craft moving toward the target to collide with another object.

In the following, a preferred but non-limiting embodiment of the disclosure is described in detail with reference to the accompanying drawings. Note that the following description is directed to an illustrative example of the technology and not to be construed as limiting to the technology. Sizes, materials, specific values, and any other factors illustrated in the embodiment are illustrative for easier understanding of the disclosure, and are not intended to limit the scope of the disclosure unless otherwise specifically stated. Further, elements in the following example embodiment which are not recited in a most-generic independent claim of the disclosure are optional and may be provided on an as-needed basis. Throughout the present specification and the drawings, elements having substantially the same function and configuration are denoted with the same reference numerals to avoid any redundant description. Further, elements that are not directly related to the disclosure are unillustrated in the drawings. The drawings are schematic and are not intended to be drawn to scale. The optimal-route generating system according to the embodiment of the present disclosure is a system for generating an optimal route used for achieving a predetermined state relative to a target. In the following description, it is assumed that the optimal-route generating system is installed in an aircraft (e.g., an accompanying aircraft when a formation flight is performed) and that the target is also an aircraft (e.g., a leader aircraft when a formation flight is performed).

Alternatively, the optimal-route generating system may be installed in either one of a vehicle and a marine vessel.

As another alternative, for example, the optimal-route generating system may be installed in either one of an aircraft and a vehicle and may wirelessly transmit a route generated by an optimal-route generating system disposed at another location to an aircraft.

Although a target for which the optimal-route generating system generates an optimal route is referred to as "first craft" hereinafter (i.e., the optimal-route generating system generates an optimal route for the first craft), the first craft may be either one of a vehicle and a marine vessel, as mentioned above, and the term "first craft" includes such cases.

Moreover, the target is not limited to an aircraft, and may alternatively be any one of a vehicle, a marine vessel, and a human. Furthermore, the target is not limited to a target that moves (referred to as "moving target" hereinafter), such as an aircraft and a vehicle, and may alternatively be, for example, a target fixed to a predetermined location in the air or on the ground (referred to as "fixed target" hereinafter).

[Overall Configuration]

FIG. 1 is a block diagram illustrating the configuration of an aircraft including the optimal-route generating system according to this embodiment.

In this embodiment, an aircraft 100 includes a flight controller 110, a flight mechanism 120, and an optimal-route generating system 1. The optimal-route generating system 1 includes an information acquiring unit 10, a storage unit 20, a route candidate generator 30, and an optimal route generator 40.

The flight controller 110 and the optimal-route generating system 1 include one or more processors and one or more storage media having stored therein programs to be executed by the one or more processors. The one or more programs include instructions. The instructions cause the one or more processors to execute control. Examples of the processors include a central processing unit (CPU), a graphics processing unit (GPU), a field-programmable gate array (FPGA), a digital signal processor (DSP), and other hardware logic structures. Examples of the storage media include a fixed storage device, such as a random access memory (RAM), a read-only memory (ROM), and a hard disk drive (HDD), and a flash memory device. In the aircraft 100, the flight controller 110 controls the flight mechanism 120, including an engine and various types of actuators, based on input information from various sensors and from a maneuvering operation.

In this embodiment, it is assumed that the optimal-route generating system 1 has already ascertained a target route when a process for generating an optimal route for the first craft is to be performed.

For example, if wireless communication can be performed between the first craft and the target, the information acquiring unit 10, such as a wireless communication module, can be used to acquire information about the position, speed, and acceleration from the target.

If wireless communication is not possible or is not to be performed between the first craft and the target, the position, speed, and acceleration of the target can be calculated from information acquired by using the information acquiring unit 10, such as any one of a radar, a camera, and a sensor. In either case, the speed and the acceleration can be calculated as a rate of change of the position and the speed.

Based on the acquired or calculated position, speed, and acceleration of the target (which may include a previously acquired or calculated position of the target), the optimal-route generating system 1 may predict a target route R0 to ascertain the target route R0.

On the other hand, the optimal-route generating system 1 may acquire a target route R0 predicted by another device or system via the information acquiring unit 10 (such as a communication network and a wireless communication unit), so that the optimal-route generating system 1 may ascertain the target route R0.

In either case, the prediction method used may be any method. The target route R0 ascertained by the optimal-route generating system 1 in the above-described manner is stored in the storage unit 20 of the optimal-route generating system 1.

The storage unit 20 also stores therein various types of data and parameters, such as a program for causing the optimal-route generating system 1 to perform a process to be described below for generating an optimal route for the first craft.

If the target is a fixed target, the target route R0 is located where the target is fixed (i.e., the speed and the acceleration are zero).

Furthermore, if the target is a fixed target, the target route R0 is not to be updated since the target route R0 (i.e., the fixed position of the target) does not change. If the target is a moving target, the state of the target (including the position, speed, and acceleration thereof) changes momentarily, so that the predicted target route R0 constantly changes. Therefore, the optimal-route generating system 1 updates the target route R0 stored in the storage unit 20 every time the predicted target route R0 changes, and performs the process for generating an optimal route for the first craft based on the updated target route R0 when the target route R0 is updated. The flight controller 110 of the aircraft 100 controls the flight mechanism 120 such that the first craft moves from the current position to a terminal position along the set optimal route.

The route candidate generator 30 and the optimal route generator 40 of the optimal-route generating system 1 will be described below.

In addition, the operation of the optimal-route generating system 1 according to this embodiment will also be described.

[Route Candidate Generator]

The route candidate generator 30 generates a plurality of route candidates R1, R2, and so on (referred to as "route candidates Rn" hereinafter) for allowing the first craft to reach a predetermined state relative to the target after a predetermined elapsed time period from the current state by changing the acceleration $a_s$ of the first craft among the current position $x_s$, speed $v_s$, and acceleration $a_s$ thereof. The position x, the speed v, and the acceleration a each indicate a three-dimensional vector, unless otherwise noted.

Furthermore, in this embodiment, the route candidate generator 30 generates a plurality of route candidates Rn by changing not only the acceleration $a_s$ of the first craft but also an elapsed time period T (i.e., a time period T for the first craft to reach the predetermined state relative to the target from the current state of the first craft).

Figure 2:
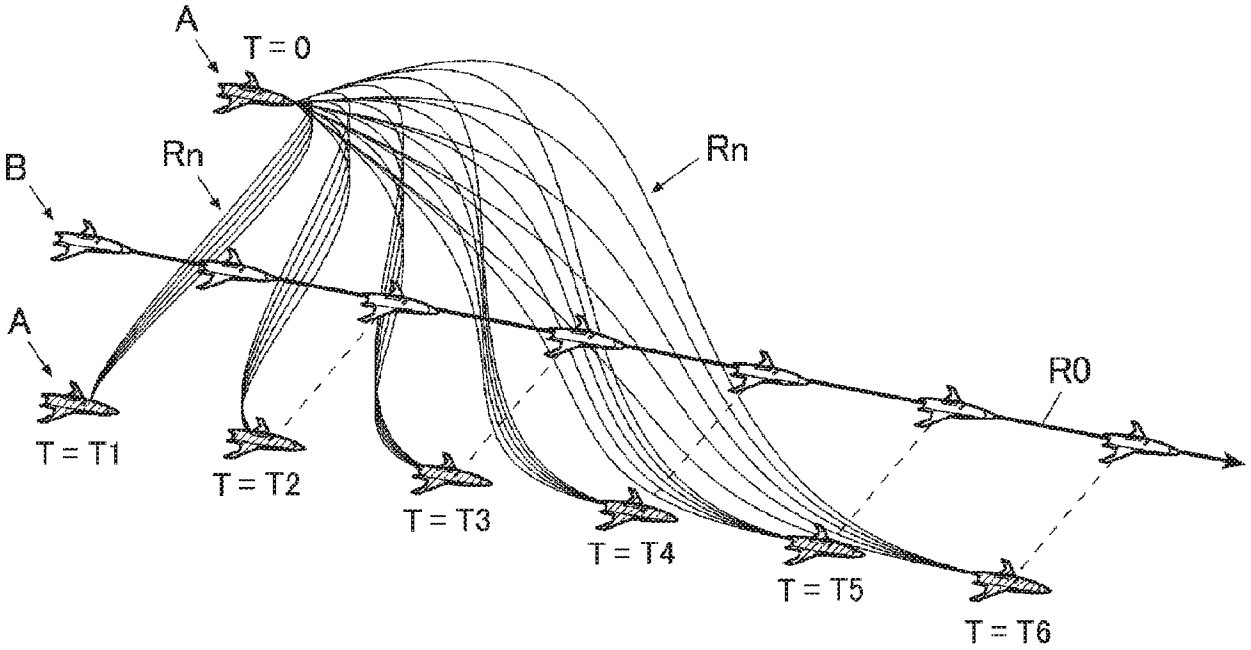
FIG. 2 is an image diagram illustrating an example of a first craft, a target, a target route, and a plurality of generated route candidates.

For example, if an optimal route is to be generated for allowing a first craft A to change from a state where it flies at the left side of a target B to a state where the first craft A is lined up sideways and flies next to the target B at the right side thereof, as illustrated in an image diagram in FIG. 2, the route candidate generator 30 generates a plurality of route candidates Rn (R1, R2, R3, and so on) for allowing the first craft A to reach a predetermined state relative to the target B (in this case, a state where the first craft A is lined up sideways and flies next to the target B) after the predetermined elapsed time period T (T=T1, T2, T3, and so on) from the current state (T=0) by varying the current acceleration $a_s$ of the first craft A and the elapsed time period T.

The predetermined state relative to the target refers to a state where, in the case of a formation flight, as illustrated in FIG. 2, the first craft A flies at the same speed as the target B (i.e., the leader aircraft) after the predetermined elapsed time period T at a position separated from the target B in a predetermined direction by a predetermined distance.

Furthermore, for example, in a case of a patrol vessel following a suspicious vessel, the first craft A (i.e., the patrol vessel) is able to catch the target B (i.e., the suspicious vessel) after the predetermined elapsed time period T. Moreover, for example, in a case of a vehicle moving toward a fixed target, the first craft A (i.e., the vehicle) can reach the target B (i.e., the fixed target) after the predetermined elapsed time period T.

This will be described in detail below.

[Setting of Initial Conditions]

The route candidate generator 30 sets the current position x, speed v, and acceleration $a_s$ of the first craft A as initial conditions based on a position command, a speed command, and an acceleration command on a route on which the first craft A is currently tracking.

Figure 3:
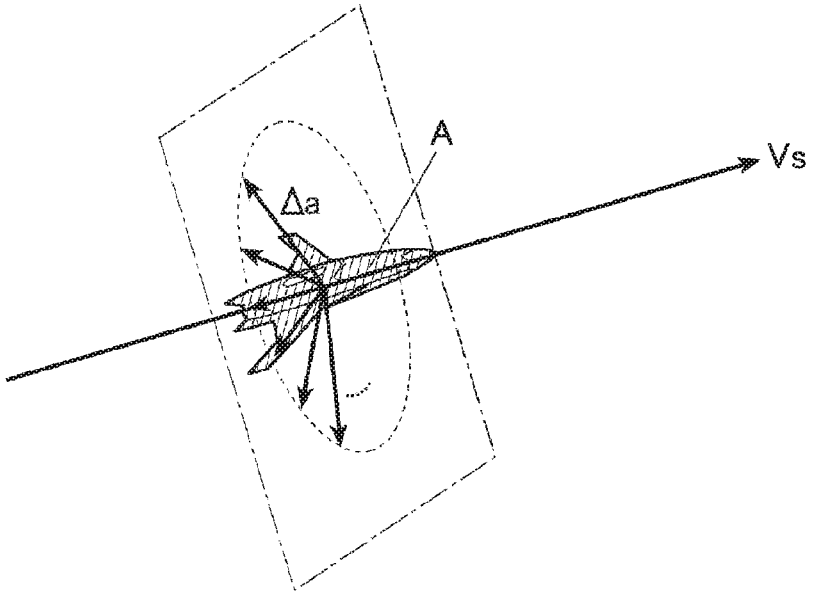
FIG. 3 illustrates an example of how variations in a plurality of acceleration values are set.

Then, in order to change the acceleration $a_s$ among the current position $x_s$, speed $v_s$, and acceleration $a_s$ of the first craft A in a plurality of patterns, the route candidate generator 30 sets variations Δa in a plurality of acceleration values a in directions orthogonal to the current traveling direction of the first craft A derived from the speed $v_s$ of the first craft A, as illustrated in, for example, FIG. 3. This may include a case where Δa=0 (the same applies hereinafter). The set variations Δa in the acceleration values a are each added to the current acceleration $a_s$ of the first craft A, so that a plurality of acceleration values $a_s$ are set.

The current position $x_s$ and speed $v_s$ of the first craft A are not to be changed from the position command and the speed command mentioned above.

When the route candidate generator 30 sets the current position $x_s$, the current speed $v_s$, and the plurality of acceleration values $a_s$ of the first craft A in the above-described manner, the route candidate generator 30 causes the storage unit 20 temporarily store the current position $x_s$, the current speed $v_s$, and the plurality of acceleration values $a_s$. Each acceleration value $a_s$ indicates an acceleration value $a_s$ after a variation Δa is added thereto.

[Setting of Terminal Conditions (Elapsed Time Period)]

Subsequently, the route candidate generator 30 sets a plurality of elapsed time periods T (T=T1, T2, and so on, see FIG. 2) as terminal conditions.

In this case, each of the elapsed time periods T may be set to any elapsed time period T in advance, and may be stored in the storage unit 20.

For example, the time it takes for the first craft A and the target B to collide with each other when the two fly toward each other in a head-on state (i.e., an opposed state) at maximum speed from the current positions of the first craft A and the target B may be defined as a shortest time period, the time it takes for the first craft A to reach a predetermined state relative to the target B by flying slowly at a speed slightly higher than the speed of the target B (i.e., 1.1 times the speed of the target B) may be defined as a longest time period, and the plurality of elapsed time periods T can be set by equally dividing a time period between the shortest time period and the longest time period (e.g., into ten equal parts).

In this case, the route candidate generator 30 causes the storage unit 20 to temporarily store the plurality of set elapsed time periods T.

[Setting of Terminal Conditions (Position, Speed, and Acceleration)]

Subsequently, the route candidate generator 30 sets a position $x_e$, speed $v_e$, and acceleration $a_e$ of the first craft A as terminal conditions in a case where the first craft A reaches the predetermined state relative to the target B after each elapsed time period T set in the above-described manner.

The position $x_e$, the speed $v_e$, and the acceleration $a_e$ of the first craft A as the terminal conditions vary for each elapsed time period T if the target B is a moving target.

In detail, the route candidate generator 30 calculates the position x0(T), the speed v0(T), and the acceleration a0(T) of the target B when the time period T has elapsed based on the predicted route R0 of the target B (e.g., see FIG. 2).

Then, if a formation flight is to be performed, the position xe of the first craft A (i.e., the first craft A having reached the predetermined state relative to the target B) as a terminal condition is set to a position separated from the position x0(T) of the target B in a predetermined direction by a predetermined distance. Furthermore, in this case, the speed $v_e$ and the acceleration $a_e$ of the first craft A as terminal conditions are set to the same values as the speed v0(T) and the acceleration a0(T) of the target B.

The route candidate generator 30 performs this process for each of the plurality of elapsed time periods T.

For each elapsed time period T, the elapsed time period T is temporarily stored in the storage unit 20 in correspondence with the position $x_e$, the speed $v_e$, and the acceleration $a_e$ of the first craft A as the terminal conditions corresponding to the elapsed time period T.

[Generation of Route Candidates]

Subsequently, while changing the acceleration $a_s$ and the elapsed time period T, the route candidate generator 30 generates a plurality of route candidates Rn (R1, R2, and so on) for allowing the first craft A to reach the predetermined state relative to the target B after the predetermined elapsed time period T from the current state (i.e., the current position $x_s$, speed $v_s$, and acceleration $a_s$) of the first craft A.

For example, the route candidate generator 30 extracts one elapsed time period T (e.g., T1) from the plurality of elapsed time periods T (=T1, T2, and so on) and generates a route candidate Rn with respect to each acceleration value $a_s$ set in the setting process of the initial conditions in accordance with the extracted elapsed time period T.

Then, the route candidate generator 30 performs this process for each elapsed time period T so as to generate a plurality of route candidates Rn.

Therefore, for example, if ten elapsed time periods T are set as the elapsed time periods T in the above-described terminal-condition setting process and nine acceleration values $a_s$ are set as the current acceleration values $a_s$ of the first craft A in the above-described initial-condition setting process, 90 route candidates Rn are generated.

Before proceeding to a detail description of how the route candidates Rn are generated in the route candidate generator 30, an example of a method for generating (calculating) a route candidate Rn will be described.

The position x, the speed v, and the acceleration a described in this example of the method for generating a route candidate Rn do not indicate a three-dimensional vector, but indicate the x component in a three-dimensional vector. Although descriptions regarding the y component and the z component of the position, speed, and acceleration (i.e., three-dimensional vector) will be omitted, the components are calculated similarly to the x component.

For example, assuming that the position x of the first craft A is expressed with a quintic function of time t, the position x of the first craft A can be expressed as in expression (1) indicated below by using the current position $x_s$, speed $v_s$, and acceleration $a_s$ of the first craft A.

$$x = x_s + v_s t + \frac{a_s}{2}t^2 + p_3 t^3 + p_4 t^4 + p_5 t^5 \tag{1}$$

where $p_3$, $p_4$, and $p_5$ indicate coefficients in the term of $t^3$, the term of $t^4$, and the term of $t^5$, respectively, when the position x of the first craft A is expressed with the quintic function of time t.

Since the speed v and the acceleration a can be calculated using a first derivative and a second derivative of the position x, the speed v and the acceleration a of the first craft A can be expressed as in expression (2) and expression (3) indicated below by performing first-order differentiation and second-order differentiation on expression (1) indicated above.

$$v = v_s + a_s t + 3p_3 t^2 + 4p_4 t^3 + 5p_5 t^4 \tag{2}$$

$$a = a_s + 6p_3 t + 12p_4 t^2 + 20p_5 t^3 \tag{3}$$

If one elapsed time period T is extracted from the plurality of elapsed time periods T, when the elapsed time period T is substituted into time t in expressions (1) to (3) indicated above, the position x, speed v, and acceleration a to be calculated are to become the position $x_e$, speed $y_e$, and acceleration $a_e$ set with respect to the elapsed time period T in the above description regarding the [Setting of Terminal Conditions (Position, Speed, and Acceleration)]. Thus, the position $x_e$, the speed $v_e$, and the acceleration $a_e$ are substituted into expressions (1) to (3) indicated above, so that expressions (4) to (6) indicated below are obtained.

$$x_e = x_s + v_s T + \frac{a_s}{2}T^2 + p_3 T^3 + p_4 T^4 + p_5 T^5 \tag{4}$$

$$v_e = v_s + a_s T + 3p_3 T^2 + 4p_4 T^3 + 5p_5 T^4 \tag{5}$$

$$a_e = a_s + 6p_3 T + 12p_4 T^2 + 20p_5 T^3 \tag{6}$$

By transforming these expressions into the form of a determinant, expression (7) indicated below is obtained.

$$\begin{bmatrix} p_3 \\ p_4 \\ p_5 \end{bmatrix} = \begin{bmatrix} T^3 & T^4 & T^5 \\ 3T^2 & 4T^3 & 5T^4 \\ 6T & 12T^2 & 20T^3 \end{bmatrix}^{-1} \begin{bmatrix} x_e - x_s - v_s T - \frac{a_s}{2}T^2 \\ v_e - v_s - a_s T \\ a_e - a_s \end{bmatrix} \tag{7}$$

Therefore, by substituting the set elapsed time period T, the current position $x_s$, speed $v_s$, and acceleration $a_s$ of the first craft A set as the initial conditions, and the position $x_e$, speed $v_e$, and acceleration $a_e$ of the first craft A set as the terminal conditions into expression (7) indicated above, coefficients $p_3$, $p_4$, and $p_5$ can be calculated.

Then, the calculated coefficients $p_3$, $p_4$, and $p_5$ are substituted into expression (1) to (3) indicated above, respectively, so that the x component of the position x, speed v, and acceleration a (i.e., three-dimensional vector) of a single route candidate Rn is calculated.

Then, this calculation is performed similarly for the y component and the z component of the position x, speed v, and the acceleration a (i.e., three-dimensional vector), so that a single route candidate Rn can be calculated and generated.

Accordingly, based on the elapsed time period T, the position $x_s$, speed $v_s$, and acceleration $a_s$ in the current state of the first craft A, and the position $x_e$, speed $v_e$, and acceleration $a_e$ when the predetermined state relative to the target B is achieved, the route candidate generator 30 calculates the coefficient $p_3$ in the term of $t^3$, the coefficient $p_4$ in the term of $t^4$, and the coefficient $p_5$ in the term of $t^5$, when the position x of the first craft A is expressed with the quintic function of time t, and performs the calculation process of expressing the position x of the first craft A with the quintic function of time t for each of the three-dimensional directions (i.e., the x direction, the y direction, and the z direction), thereby generating route candidates Rn.

The method for generating route candidates Rn is not limited to the above-described method, and another alternative method may be employed.

When the route candidate generator 30 generates a plurality of route candidates Rn in the above-described manner, the route candidate generator 30 causes the storage unit 20 to temporarily store the generated route candidates Rn (see FIG. 1).

[Optimal Route Generator]

The optimal route generator 40 (see FIG. 1) generates an optimal route by selecting a route candidate Rn with an optimal evaluation result based on an evaluation function from among route candidates Rn, included in the route candidates Rn generated by the route candidate generator 30 in the above-described manner, not deviating from predetermined limitations and unlikely to collide with another object, such as either one of the ground and the target B.

[Limitations and Route Correction]

The term "limitations" mentioned above will be described below.

The route candidates Rn generated by the route candidate generator 30 in the above-described manner may include a route candidate Rn on which, when the first craft A flies along the route candidate Rn, for example, the speed of the first craft A may exceed the maximum speed of the first craft A, extraordinarily large gravitational acceleration may act on the pilot, or the first craft A may collide with the ground or the target B (or another object) in a segment on the route candidate Rn.

Since such a route is not desirable, for example, the following limitations are set for the route candidates Rn in this embodiment.

1. The speed is lower than or equal to the maximum speed.
2. The pilot receives gravitational acceleration of 5 G or lower.
3. The attack angle is 30 degrees of smaller.
4. The altitude is 200 m or higher.
5. The separation distance from another craft is 50 m or more.
6. Entry to a danger area is prohibited.

A danger area includes, for example, a no-flight zone, an area surrounding a missile launching site, and a location where air turbulence is occurring.

The limitations are appropriately set in accordance with the conditions. For example, in a case of an acrobatic flight, the limitation (5) related to the separation distance from another craft (such as a leader aircraft) may be shortened, or the limitation related to the separation distance may be eliminated.

If the generated route candidate Rn deviates from the predetermined limitations mentioned above, the optimal route generator 40 generates the route candidate Rn again by correcting the position x and the speed v in the limitation-deviated segment to a predetermined position x and a predetermined speed v.

For example, if the generated route candidate Rn has a segment where the altitude is lower than 200 m, the optimal route generator 40 corrects the route candidate Rn such that the altitude is equal to 200 m in that segment. Furthermore, for example, if the generated route candidate Rn has a segment where the speed exceeds the maximum speed, the optimal route generator 40 corrects the route candidate Rn such that the speed is equal to the maximum speed (or a speed slightly lower than the maximum speed) in that segment.

[Thrust Performance]

When the first craft A flies along the generated route candidate Rn, if the total amount of the work used for accelerating the first craft A and the resistance loss caused by the air exceeds the thrust performance of the first craft A, it is difficult for the first craft A to fly along the route candidate Rn.

Therefore, in this embodiment, assuming that a route candidate Rn is to be selected, the optimal route generator 40 selects, as a candidate for an optimal route Rbest, a route candidate Rn on which the total amount of the work used for accelerating the first craft A and the resistance loss does not exceed the thrust performance of the first craft A in all segments of the generated route candidate Rn (i.e., from when the time t is 0 to when the set time period T elapses).

In this embodiment, an evaluation value Q1 in view of a difference between the total amount of the work used for accelerating the first craft A and the resistance loss and the thrust performance of the first craft A is used as an evaluation related to the thrust performance of the first craft A.

Figure 4:
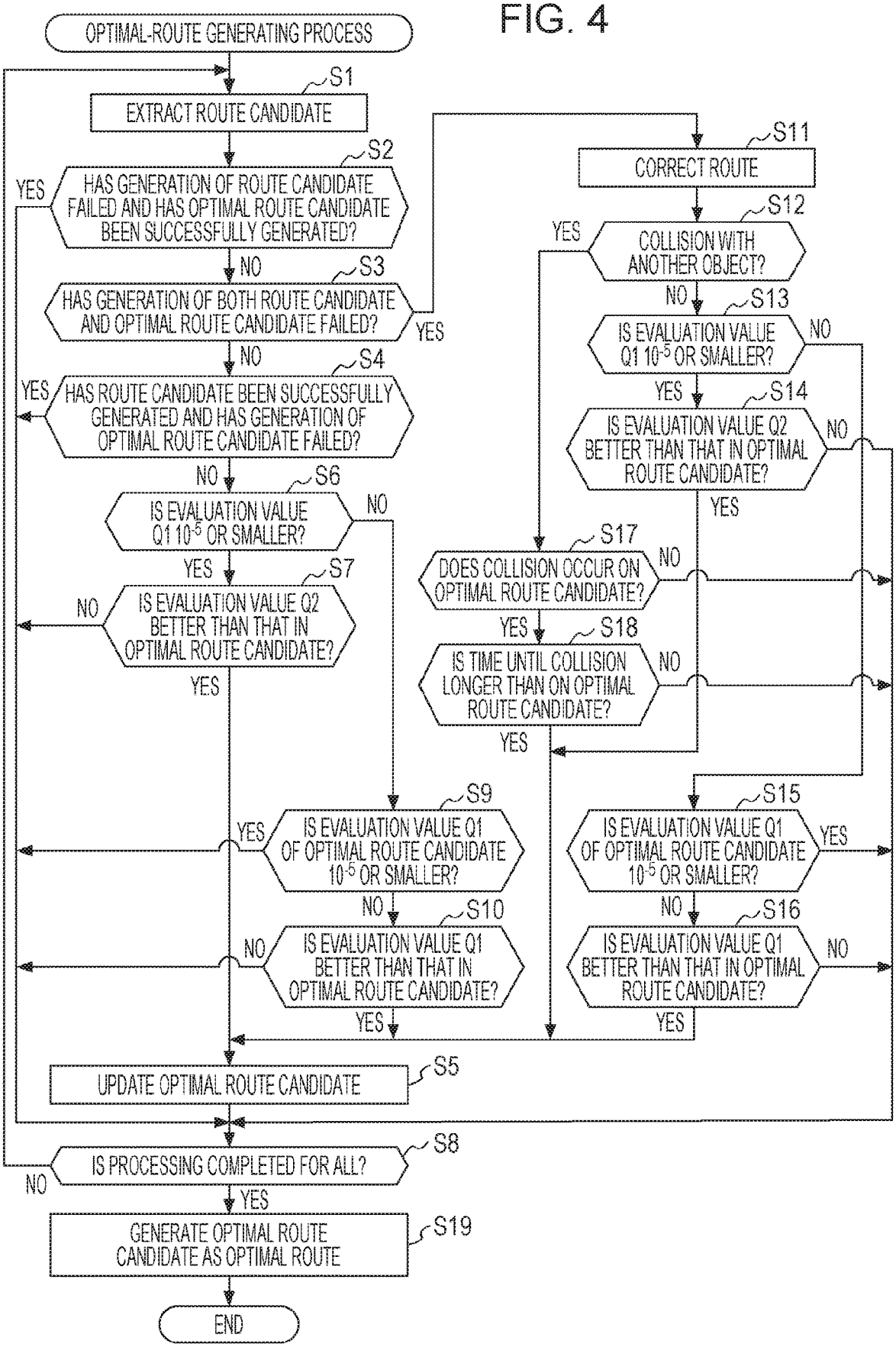
FIG. 4 is a flowchart illustrating a procedure of an example of a process performed in an optimal route generator.

Furthermore, although it is desirable that the aforementioned evaluation value Q1 is theoretically 0 or smaller, a criterion for determining whether the evaluation value Q1 is $10^{-5}$ or smaller instead of 0 or smaller is used as an insurance against a numerical error in a program (see FIG. 4 to be described later).

[Evaluation Result Based on Evaluation Function]

As described above, the optimal route generator 40 selects, as an optimal route Rbest, a route candidate Rn on which an optimal evaluation result is obtained based on an evaluation function.

The evaluation function is set based on the most notable viewpoint when an optimal route Rbest is to be selected.

For example, if an optimal route Rbest is to be selected based on a viewpoint of reducing the energy loss when the first craft A flies along the route candidate Rn, the optimal route generator 40 may calculate an evaluation value Q2 as an evaluation result calculated with an evaluation function used for calculating the total amount of the work used for accelerating the first craft A and the resistance loss.

Although the following description relates to the case where the energy loss is to be minimized in this manner, for example, if an optimal route Rbest is to be selected based on the viewpoint of reducing the energy loss when the first craft A flies along the route candidate Rn, the aforementioned elapsed time period T may be used as either one of the evaluation function and the evaluation value Q2.

In this case, for example, a plurality of elapsed time periods T are set such that the intervals between the aforementioned elapsed time periods T are small. A route candidate Rn with the shortest elapsed time period T (i.e., with an optimal evaluation result) is selected from among route candidates Rn, included in the generated route candidates Rn, not deviating from the limitations and not causing collisions with another object, such as either one of the ground and the target B.

Furthermore, by appropriately setting the evaluation function based on the most notable viewpoint when an optimal route Rbest is to be selected, the optimal route Rbest can be generated with respect to the viewpoint.

[Example of Optimal-Route Generating Process]

An example of the process performed in the optimal route generator 40 will be described below with reference to a flowchart in FIG. 4.

In this embodiment, the optimal route generator 40 sequentially extracts a route candidate Rn from a plurality of route candidates Rn in step S1, and updates an optimal route candidate stored in the memory to the route candidate Rn in step S5 every time there is a more appropriate route candidate Rn. The optimal route candidate Rn selected in this manner (i.e., the optimal route candidate ultimately remaining in the memory) is generated as an optimal route Rbest in step S19.

This will be described below in detail.

In step S1, the optimal route generator 40 extracts one route candidate Rn from a plurality of route candidates Rn generated by the route candidate generator 30 in the above-described manner.

Then, the optimal route generator 40 performs determination processes in steps S2 and S3. In the determination processes in steps S2 and S3, if the extracted route candidate Rn and the optimal route candidate stored in the memory do not deviate from the limitations described above and have satisfied all conditions, the expression "successfully generated" is used, whereas if the route candidate Rn and the optimal route candidate deviate from the limitations described above and have not satisfied at least one of the conditions, the expression "generation failed" is used.

If the generation of the extracted route candidate Rn has failed but the optimal route candidate stored in the memory has been successfully generated (YES in step S2), the successfully-generated optimal route candidate (i.e., an optimal route candidate not deviating from the above-described limitations) is to be selected in priority over the generation-failed route candidate Rn (i.e., a route candidate Rn deviating from the above-described limitations), so that the optimal route generator 40 ends the process without performing further processing with respect to the extracted route candidate Rn. Therefore, in this case, the optimal route candidate is not updated in step S5.

In contrast, if the determination result in step S2 indicates NO, the optimal route generator 40 subsequently determines in step S3 whether the generation of both the extracted route candidate Rn and the optimal route candidate stored in the memory has failed.

The process to be performed when the determination result in step S3 indicates YES will be described later.

If the determination result in step S3 indicates NO, the route candidate Rn and the optimal route candidate have both been successfully generated at this point, or the route candidate Rn has been successfully generated but the generation of the optimal route candidate has failed at this point.

If the route candidate Rn has been successfully generated but the generation of the optimal route candidate has failed, the successfully-generated route candidate Rn (i.e., a route candidate Rn not deviating from the above-described limitations) is to be selected in priority due to the same reason as above.

Therefore, if the route candidate Rn has been successfully generated but the generation of the optimal route candidate has failed (YES in step S4), the optimal route generator 40 updates the optimal route candidate stored in the memory to the currently-extracted route candidate Rn in step S5.

In this embodiment, route candidates Rn generated successfully without deviating from the above-described limitations are selected from a plurality of route candidates Rn, and an optimal route Rbest is selected from the selected route candidates Rn.

If the determination result in step S3 indicates NO, the route candidate Rn and the optimal route candidate have both been successfully generated at this point.

Subsequently, in step S6, the optimal route generator 40 determines whether the evaluation value Q1 in the extracted route candidate Rn (i.e., the evaluation value Q1 related to the thrust performance of the first craft A mentioned above) is $10^{-5}$ or smaller. As mentioned above, the evaluation value Q1 related to the thrust performance is set to be $10^{-5}$ or smaller instead of 0 or smaller.

If the evaluation value Q1 in the extracted route candidate Rn is $10^{-5}$ or smaller (YES in step S6), the optimal route generator 40 determines in step S7 whether the evaluation value Q2 in the extracted route candidate Rn (i.e., the evaluation value Q2 as an evaluation result based on the evaluation function mentioned above) is better than the evaluation value Q2 in the optimal route candidate stored in the memory (i.e., smaller than the evaluation value Q2 in this case).

If the evaluation value Q2 in the extracted route candidate Rn is better than the evaluation value Q2 in the optimal route candidate (YES in step S7), the optimal route generator 40 updates the optimal route candidate stored in the memory to the currently-extracted route candidate Rn in step S5. If the evaluation value Q2 in the extracted route candidate Rn is poorer than the evaluation value Q2 in the optimal route candidate (NO in step S7), the optimal route generator 40 does not update the optimal route candidate.

In this embodiment, if the evaluation value Q1 related to the thrust performance with respect to either one of the route candidate Rn and the optimal route candidate is equal to or smaller than $10^{-5}$, the one with the better evaluation result based on the evaluation function remains as an optimal route candidate.

Then, unless the process is completed for all route candidates Rn (NO in step S8), the optimal route generator 40 returns to step S1 to extract a subsequent route candidate Rn. On the other hand, if the determination result in step S6 indicates that the evaluation value Q1 of the currently-route candidate Rn is larger than $10^{-5}$ (NO in step S6), the optimal route generator 40 determines in step S9 whether the evaluation value Q1 in the optimal route candidate stored in the memory is $10^{-5}$ or smaller.

If the evaluation value Q1 in the optimal route candidate is $10^{-5}$ or smaller (YES in step S9), the optimal route generator 40 does not update the optimal route candidate since the optimal route candidate is not to be updated to the route candidate Rn with the evaluation value Q1 larger than $10^{-5}$. In a case where the evaluation value Q1 in the currently-extracted route candidate Rn is larger than $10^{-5}$ (NO in step S6) and the evaluation value Q1 in the optimal route candidate is also larger than $10^{-5}$ (NO in step S9), if the evaluation value Q1 in the route candidate Rn is better than that in the optimal route candidate (YES in step S10), the optimal route generator 40 updates the optimal route candidate stored in the memory to the currently-extracted route candidate Rn in step S5. If the evaluation value Q1 in the optimal route candidate is better (NO in step S10), the optimal route candidate is not updated.

Although there is no guarantee as to whether recovery is possible, it is conceivable that the possibility of recovery increases with better evaluation value Q1 (i.e., with decreasing degree by which the total amount of the work used for accelerating the first craft A and the resistance loss exceeds the thrust performance of the first craft A).

Therefore, in this embodiment, if the evaluation values Q1 in both the route candidate Rn and the optimal route candidate are larger than $10^{-5}$, as described above, the optimal route generator 40 selects the one with the better evaluation value Q1 as an optimal route candidate.

Accordingly, in this embodiment, if the currently-generated route candidate Rn and the optimal route candidate stored in the memory are both successfully generated, steps S6 and S7 described above or steps S9 and S10 described above are performed.

The following description relates to a case where the determination result in step S3 indicates YES, that is, a case where the generation of either one of the currently-extracted route candidate Rn and the optimal route candidate stored in the memory has failed.

If there is a successfully-generated optimal route candidate already stored in the memory, the optimal route candidate is not to be updated to a route candidate Rn that is not successfully generated, as described above, meaning that the determination result in step S3 indicates NO. Thus, the following steps are not performed.

If the determination result in step S3 indicates YES (i.e., if the currently-extracted route candidate Rn deviates from the aforementioned limitations), the optimal route generator 40 generates the route candidate Rn again by correcting the position x in the segment of the route candidate Rn deviating from the limitations (e.g., correcting the altitude to 200 m in a segment where the altitude is below 200 m) or correcting the speed v (e.g., correcting the speed v to the maximum speed (or a speed slightly lower than the maximum speed) in a segment where the speed v exceeds the maximum speed) in step S11.

When the first craft A flies along the route candidate Rn corrected in this manner, if the first craft A does not collide with another object, such as either one of the ground and the target B (see FIG. 2) (NO in step S12), the optimal route generator 40 performs determination processes in steps S13 to S16 similarly to the determination processes in steps S6, S7, S9, and S10 described above, and updates the optimal route candidate stored in the memory to the currently-extracted route candidate Rn in step S5, where appropriate.

As mentioned above, the determination processes in steps S6, S7, S9, and S10 are performed when the currently-extracted route candidate Rn and the optimal route candidate stored in the memory have both been successfully generated. In contrast, the determination processes in steps S13 to S16 are performed when the generation of both the currently-extracted route candidate Rn and the optimal route candidate stored in the memory has failed.

On the other hand, if the determination result in step S12 indicates that the first craft A may collide with another object when the first craft A flies along the corrected route candidate Rn (YES in step S12), the optimal route generator 40 determines in step S17 whether the first craft A may collide with another object when the first craft A flies along the optimal route candidate stored in the memory.

If the first craft A does not collide with another object when the first craft A flies along the optimal route candidate (NO in step S17), the optimal route candidate on which the first craft A does not collide with another object is to be selected in priority over the route candidate Rn on which the first craft A may collide with another object. Therefore, the optimal route generator 40 does not update the optimal route candidate.

In a case where the first craft A may collide with another object even when the first craft A flies along the optimal route candidate (YES in step S17), if the time it takes for the first craft A flying along the currently-extracted route candidate Rn to collide with another object is longer than when the first craft A flies along the optimal route candidate (YES in step S18), the optimal route generator 40 updates the optimal route candidate stored in the memory to the currently-extracted route candidate Rn in step S5.

However, if the time it takes for the first craft A flying along the optimal route candidate to collide with another object is longer (NO in step S18), the optimal route candidate is not updated.

For example, if the first craft A may collide with another object when the first craft A flies along whichever one of the currently-extracted route candidate Rn and the optimal route candidate stored in the memory, the optimal route generator 40 keeps the route with the longer time to the collision as an optimal route candidate.

The reasons for such a configuration are as follows.

As mentioned above, in this embodiment, every time the predicted route R0 (see FIG. 1 and FIG. 2) of the target B is updated, the optimal-route generating system 1 performs the process for generating an optimal route Rbest for the first craft A based on the updated route R0 of the target B.

Therefore, even in a situation where only an optimal route Rbest on which the first craft A may collide with another object, such as either one of the ground and the target B, can be generated based on the currently-predicted route R0 of the target B and the current position x, speed v, and acceleration a of the first craft A, the predicted route R0 of the target B is updated and the current position x, speed v, and acceleration a of the first craft A have changed when the subsequent process for generating an optimal route Rbest is performed. Thus, an optimal route Rbest on which the first craft A does not collide with another object may possibly be generated.

Consequently, in a situation where only an optimal route Rbest on which the first craft A may collide with another object can be generated, it is desirable that a route with the longer time to the collision as much as possible is generated as an optimal route candidate, and to wait until a situation where an optimal route Rbest on which the first craft A does not collide with another object is reached.

Accordingly, as mentioned above, in this embodiment, if each of the generated route candidates Rn is a route on which the first craft A flying along the route candidate Rn may collide with another object, including the ground and the target B, the optimal route generator 40 selects a route candidate Rn with the longest time to the collision.

In step S8, the optimal route generator 40 performs each of the above steps on each of the route candidates Rn generated by the route candidate generator 30.

Then, when the process is completed for all of the route candidates Rn (YES in step S8), the optimal route candidate ultimately remaining in the memory is generated as an optimal route Rbest in step S19.

[Example Effects]

Accordingly, in the optimal-route generating system 1 according to this embodiment, the route candidate generator 30 generates a plurality of route candidates Rn for allowing the first craft A to reach a predetermined state relative to the target B after the predetermined elapsed time period T from the current state of the first craft A by changing the acceleration $a_s$ of the first craft A among the current position $x_s$, speed $v_s$, and acceleration $a_s$ thereof. Furthermore, the optimal route generator 40 generates an optimal route Rbest by selecting a route candidate Rn with an optimal evaluation result (i.e., the evaluation value Q2 in the above example) based on an evaluation function from among route candidates Rn, included in the generated route candidates Rn, not deviating from predetermined limitations and not causing collisions with another object, such as either one of the ground and the target B.

Therefore, an optimal route Rbest for allowing the first craft A to reach a predetermined state relative to the target B can be generated without causing the first craft A moving toward the target B to collide with another object not only when the first craft A and the target B are already approaching each other but also when the first craft A is located away from the target B.

In the optimal-route generating system 1 according to this embodiment, an evaluation function is appropriately set based on the most important viewpoint when an optimal route Rbest is to be selected, so that an optimal route Rbest best suited for this viewpoint can be automatically generated.

An embodiment of the present disclosure is not limited to the above-described embodiment, and may be modified, as appropriate, so long as the modification does not deviate from the scope of the disclosure.

The invention claimed is:

1. An optimal-route generating system comprising:

one or more processors; and one or more storage media storing programs that, when executed by the one or more processors, cause the one or more processors to:

generate an optimal route for a first craft to travel from a current position of the first craft to a predetermined position relative to a target position of a target, wherein the one or more processors is further configured to:

predict i) a first target position of the target after a first time period elapses from a current time and ii) a second target position of the target after a second time period elapses from the current time, the first time period being shorter than the second time period;

generate a plurality of first route candidates based on i) the current position of the first craft, ii) a current speed of the first craft, and iii) a plurality of first acceleration values, wherein each first route candidate of the plurality of first route candidates extends from the current position of the first craft to a first predetermined position relative to the first target position of the target, and wherein the plurality of first route candidates are respectively generated based on the plurality of first acceleration values;

generate a plurality of second route candidates based on i) the current position of the first craft, ii) the current speed of the first craft, and iii) a plurality of second acceleration values, wherein each second route candidate of the plurality of second route candidates extends from the current position of the first craft to a second predetermined position relative to the second target position of the target, and wherein the plurality of second route candidates are respectively generated based on the plurality of second acceleration values;

calculate, for each first route candidate of the plurality of first route candidates, a first total amount of work used for accelerating the first craft and a resistance loss in the first route candidate as a first evaluation value based on an evaluation function;

calculate, for each second route candidate of the plurality of second route candidates, a second total amount of work used for accelerating the first craft and a resistance loss in the second route candidate as a second evaluation value based on the evaluation function;

determine a smallest evaluation value out of the calculated first evaluation values for the plurality of first route candidates and the calculated second evaluation values for the plurality of second route candidates;

select, from the plurality of first route candidates and the plurality of second route candidates, a single route candidate corresponding to the smallest evaluation value; and generate the optimal route by setting, as the optimal route, the selected single route candidate corresponding to the smallest evaluation value, wherein the plurality of first route candidates and the plurality of second route candidates, from which the optimal route is selected, do not deviate from a predetermined limitation and avoid colliding with another object including either one of a ground and the target, wherein a flight mechanism of the first craft controls the first craft based on the generated optimal route, and wherein the one or more processors are configured to generate each of the plurality of first route candidates and the plurality of second route candidates by performing a calculation process for each of three-dimensional directions, the calculation process comprising calculating a coefficient $p_3$ in a term of $t^3$, a coefficient $p_4$ in a term of $t^4$, and a coefficient $p_5$ in a term of $t^5$, in a case where a position of the first craft is expressed with a quintic function of time t, on a basis of i) the elapsed first or second time period, ii) the current position, iii) the current speed, iv) the first or second acceleration values, and v) the first or second predetermined position, a speed, and an acceleration value of the first craft when the first craft reaches the predetermined first or second position relative to the first or second target position of the target.

2. The optimal-route generating system according to claim 1, wherein the one or more processors are configured to select, as a candidate for the optimal route, a route candidate on which a total amount of work used for accelerating the first craft and a resistance loss does not exceed thrust performance of the first craft in all segments of the route candidate.

3. The optimal-route generating system according to claim 1, wherein in response to determining that each of the plurality of first route candidates and the plurality of second route candidates deviates from the predetermined limitation, the one or more processors regenerate the plurality of first route candidates and the plurality of second route candidates by correcting either one of a position and a speed in a segment where a deviation from the predetermined limitation has occurred to either one of a predetermined position and a predetermined speed.

4. The optimal-route generating system according to claim 1, wherein in response to determining that each of the plurality of first route candidates and the plurality of second route candidates is a route on which the first craft flying along allow the first craft to collide with another object comprising either one of the ground and the target, the one or more processors select a route candidate with a longest time to the collision.

5. An optimal-route generating system comprising:

circuitry configured to generate an optimal route for a first craft to travel from a current position of the first craft to a predetermined position relative to a target position of a target, wherein the circuitry is configured to:

predict i) a first target position of the target after a first time period elapses from a current time and ii) a second target position of the target after a second time period elapses from the current time, the first time period being shorter than the second time period;

generate a plurality of first route candidates based on i) the current position of the first craft, ii) a current speed of the first craft, and iii) a plurality of first acceleration values, wherein each first route candidate of the plurality of first route candidates extends from the current position of the first craft to a first predetermined position relative to the first target position of the target, and wherein the plurality of first route candidates are respectively generated based on the plurality of first acceleration values;

generate a plurality of second route candidates based on i) the current position of the first craft, ii) the current speed of the first craft, and iii) a plurality of second acceleration values, wherein each second route candidate of the plurality of second route candidates extends from the current position of the first craft to a second predetermined position relative to the second target position of the target, and wherein the plurality of second route candidates are respectively generated based on the plurality of second acceleration values;

calculate, for each first route candidate of the plurality of first route candidates, a first total amount of work used for accelerating the first craft and a resistance loss in the first route candidate as a first evaluation value based on an evaluation function;

calculate, for each second route candidate of the plurality of second route candidates, a second total amount of work used for accelerating the first craft and a resistance loss in the second route candidate as a second evaluation result based on the evaluation function;

determine a smallest evaluation value out of the calculated first evaluation values for the plurality of first route candidates and the calculated second evaluation values for the plurality of second route candidates;

select, from the plurality of first route candidates and the plurality of second route candidates, a single candidate corresponding to the smallest evaluation value;

generate the optimal route by setting, as the optimal route, the selected single route candidate corresponding to the smallest evaluation value, wherein the plurality of first route candidates and the plurality of second route candidates, from which the optimal route is selected, do not deviate from a predetermined limitation and avoid colliding with another object including either one of a ground and the target; and control a flight mechanism of the first craft based on the generated optimal route, wherein the circuitry is configured to generate each of the plurality of first route candidates and the plurality of second route candidates by performing a calculation process for each of three-dimensional directions, the calculation process comprising calculating a coefficient $p_3$ in a term of $t^3$, a coefficient $p_4$ in a term of $t^4$, and a coefficient $p_5$ in a term of $t^5$, in a case where a position of the first craft is expressed with a quintic function of time t, on a basis of i) the elapsed first or second time period, ii) the current position, iii) the current speed, iv) the first or second acceleration values, and v) the first or second predetermined position, a speed, and an acceleration value of the first craft when the first craft reaches the predetermined first or second position relative to the first or second target position of the target.

6. The optimal-route generating system according to claim 1, wherein the one or more processors generates the plurality of first route candidates such that when the first craft reaches the first predetermined position relative to the first target position of the target after the elapsed first time period, the first craft travels at a same speed as the target at the first target position, and wherein the one or more processors generates the plurality of second route candidates such that when the first craft reaches the second predetermined position relative to the second target position of the target after the elapsed second time period, the first craft travels at a same speed as the target at the second target position.

* * * * *